US005527136A

United States Patent [19]

Bayazitoglu et al.

[11] Patent Number: 5,527,136

[45] Date of Patent: Jun. 18, 1996

[54] MONO-TRIPOD PLATFORM

[75] Inventors: Yildirim O. Bayazitoglu; James A. Starewich, both of Houston, Tex.

[73] Assignee: Halliburton Company, Houston, Tex.

[21] Appl. No.: 270,874

[22] Filed: Jul. 5, 1994

[51] Int. Cl.[6] ..... E02B 17/02

[52] U.S. Cl. ..... 405/227

[58] Field of Search ..... 405/195.1, 203, 405/204, 226, 227; 175/7

[56] References Cited

U.S. PATENT DOCUMENTS

| | | | |
|---|---|---|---|
| 4,307,977 | 12/1981 | Haney | 405/227 |
| 4,561,802 | 12/1985 | Campo | 405/195 |
| 4,621,949 | 11/1986 | Marshall et al. | 405/227 |
| 4,797,034 | 1/1989 | Danguy des Deserts et al. | 405/202 |
| 4,917,541 | 4/1990 | Carruba | 405/227 |
| 4,983,074 | 1/1991 | Carruba | 405/227 |
| 5,094,568 | 3/1992 | Carruba | 405/227 |
| 5,102,266 | 4/1992 | Carruba | 405/227 |
| 5,122,010 | 6/1992 | Burguieres, Jr. et al. | 405/204 |
| 5,181,799 | 1/1993 | Carruba | 405/195 |

FOREIGN PATENT DOCUMENTS

| | | | |
|---|---|---|---|
| 9008232 | 7/1990 | WIPO | 405/227 |

*Primary Examiner*—William P. Neuder
*Attorney, Agent, or Firm*—Conley, Rose & Tayon

[57] ABSTRACT

An offshore structure for use in a body of water at a depth of from 600 to 1000 feet having a tripod or quadropod base section in which each leg is battered at a ratio of from 1:8 to 1:10, extending upwardly from its lower end on the floor of the body of water to its upper end at least 50 feet below the surface of the body of water, a monopod mounted near the upper end of the base section, substantially centrally disposed and extending upwardly to a level above the water, and a platform mounted on top of the monopod. The structure has a natural period of no more than about six seconds.

8 Claims, 1 Drawing Sheet

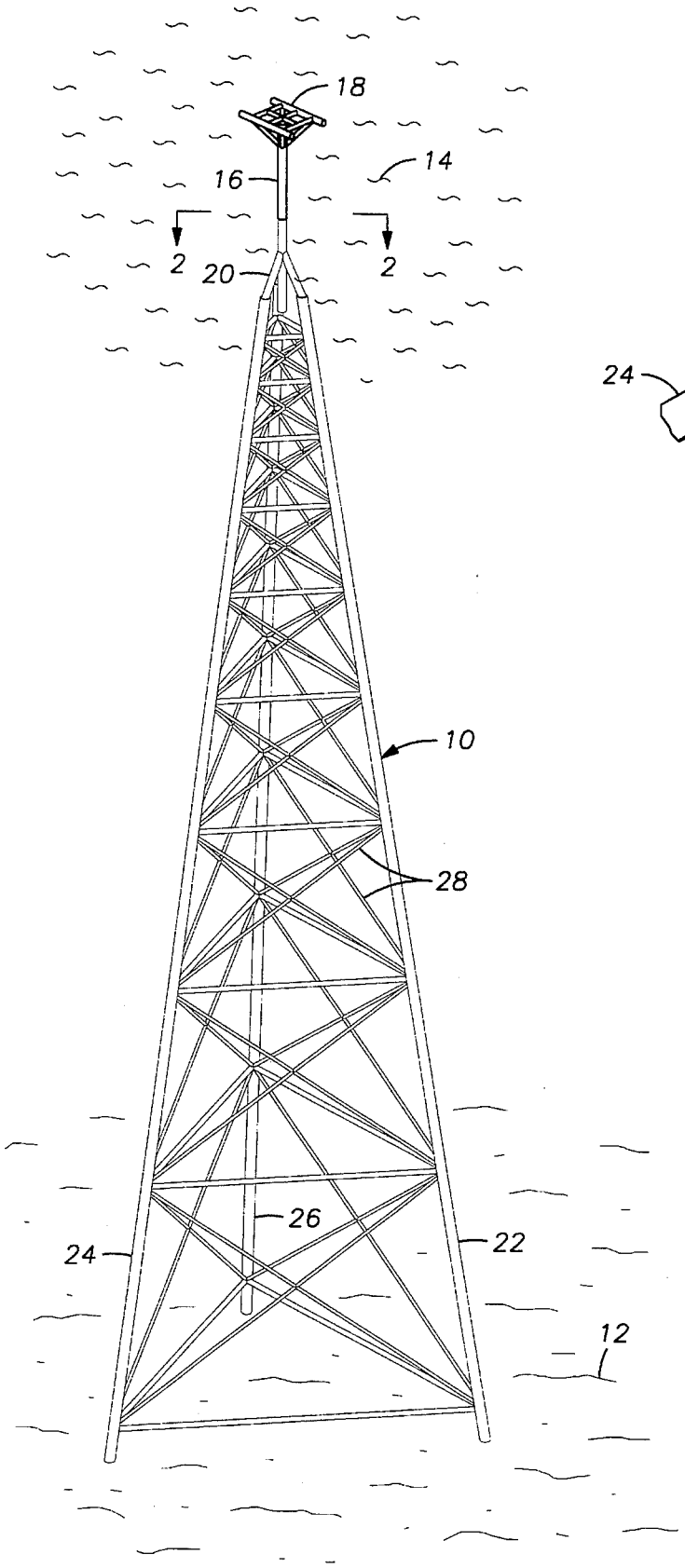
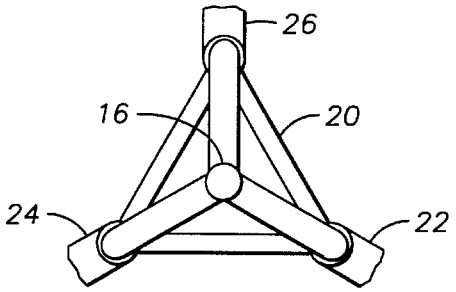
FIG. 2
FIG. 1

MONO-TRIPOD PLATFORM

FIELD OF THE INVENTION

This invention relates to offshore support structures for use in connection with oil and gas wells located in a body of water.

DESCRIPTION OF THE PRIOR ART

Production of oil and gas from wells at offshore locations often requires the use of equipment which must be mounted on a platform positioned on top of a large steel structure which extends from the floor of the body of water to a distance above the water higher than the highest waves which may occur. Equipment for producing the well is mounted on the platform, and workover equipment may be temporarily placed on the platform when necessary for working on the well. These offshore structures often sit in hundreds of feet of water, so in addition to supporting the sometimes very heavy weight of the platform and equipment, a structure must be built to withstand wave action, which can generate very large lateral forces. For these reasons, offshore structures are often exceedingly large, massive and expensive. In many cases, the cost of the offshore structure is the deciding factor in determining whether it is desirable to try to find and produce oil or gas from a particular location. It is, therefore, highly desirable to reduce the cost of such structures so that the cost of placing oil and gas wells in production is minimized. If costs can be reduced, marginal wells may become economically viable.

One common design of offshore support structure for use in water depths up to 600 feet uses three or four interconnected and braced legs, which legs extend from the mud surface beneath the body of water to above the surface of the water. The legs are "battered" or sloped outwardly as they extend downwardly, so that the cross-sectional configuration at the top of the structure is smaller than the cross-sectional configuration at the base. Typically, a single pile is driven downwardly through each leg from the top of the offshore structure into the earth beneath the body of water in order to anchor and secure the structure against wave loads. A platform for supporting production and workover equipment is constructed on top of the structure.

All such offshore structures are subjected to the lateral loading caused by waves, as well as the vertical load of the platform and equipment on the platform. Each offshore structure has a natural frequency, or period, of response to the wave action, the period varying depending on the stiffness and the geometry of the structure. Relatively stiff structures for use in deep water, in particular, are designed so that their natural periods are lower than storm wave periods, however, comparatively flexible structures may be designed so that their natural periods are greater than the expected storm wave periods. Waves encountered may have periods ranging from about one second to about 18 seconds, while storm waves, which are of most concern, will usually have periods of about 13 to 16 seconds. When the natural period of the structure is close to the wave period, the inertia of the structure dynamically amplifies the lateral load of the wave on the structure. In addition, the amount of lateral loading varies with the configuration and area of the elements of the structure which are impacted by the waves. The total lateral load which the structure must be able to withstand is the total of the wave load on the structural elements impacted by the waves and the inertial load.

When the offshore structure is to be installed in very deep water, for example 600 feet to 1,000 feet or more, it must be constructed with much larger and therefore heavier and more expensive structural elements in order to provide sufficient strength and stiffness, and a low enough natural period, to withstand the lateral loading. Generally, it is desirable to design such structures for a natural period of 8 seconds or less. However, the larger structural elements provide an increased area for receiving the wave loads, thereby increasing the load on the structure. In some applications, the amount of increased load is such as to be counterproductive, in that the inertial loading is increased to a point which requires still more structure.

To avoid this problem, flexible, or compliant, structures have been provided, which have a natural period of twenty seconds or more, substantially greater than the wave period and with therefore a significantly reduced dynamic amplification. Such flexible designs are described, for example, in U.S. Pat. No. 4,797,034 and in the patents discussed therein. Such flexible structures are very expensive, as compared to the rigid structures used in shallower water.

Previous efforts have been made to reduce the surface area upon which the water acts so as to have a smaller wave load, by supporting the platform on a single vertical tubular leg through which a pile is driven, the leg being braced by underwater braces attached to skirt piles. Such designs are shown, for example, in U.S. Pat. Nos. 4,983,074 and 5,094,568 to Carruba and in U.S. Pat. No. 5,122,010 to Burguieres. However, these structures are useful only in relatively shallow water, under 300 feet and all of the vertical gravity load must be supported on the single vertical column. Moreover, the configurations of the structures are such that they must be fabricated and transported in vertical upright position, which limits the feasible water depth in which they can be used. The Burguieres design may be fabricated and transported in a horizontal position, but it has the disadvantage of requiring separate fabrication and installation of the vertical leg and the outrigger skirt pile support structure which increases the number of steps required to be taken to successfully install the platform, and, therefore, increases the cost. Moreover, the Burguieres patent says that this concept is suitable for water depths only up to 250 feet.

There is, therefore, a need for an offshore platform structure which is suitable for water depths up to 1,000 feet, which have a low wave load, and which are less expensive than the flexible structures which have previously been available for such water depths.

SUMMARY OF THE INVENTION

The present invention achieves the foregoing objectives through use of a combination of a single column, or monopod, mounted on a three or four leg structure in which only the monopod is subjected to wave action. A monopod has a circular cross-section, which has a reduced resistance to wave action as compared to other configurations, and lends itself to low periods and low dynamic amplification which makes the use of the structure possible for water depths up to 1,000 feet. In addition, the dynamic characteristics (mode shape) of the combination monopod/tripod or quadropod is such that the inertial loads resulting from dynamic analysis are less than other structures. The monopod of this structure does not extend to the sea bed, but is supported from the upper end of the tripod or quadropod structure. The monopod may be centrally disposed of the legs of the structure so as to equally distribute the weight among the legs. The tripod or quadropod supporting the monopod rests on the bottom of the body of water, and extends upwardly to a level at least about 50 feet below the surface of the water. The legs of the tripod or quadropod are connected together with lateral bracing. To provide sufficient lateral stability without unnecessary size, weight and cost, the legs are battered, preferably in a batter within the range of about 1 to 8 to about 1 to 10.

The offshore support structure and method of the present invention has the advantages over structures previously available of being capable of fabrication and transport in the horizontal position, of being useful in water depths of up to 1,000 feet and of being much lighter, and therefore much less expensive, than offshore structures previously provided for water of such depth. Moreover, it can be completely constructed and transported in a single structure, with no assembly required at the wellsite.

BRIEF DESCRIPTION OF THE DRAWINGS

FIG. 1 is a perspective view of one embodiment of an offshore support structure in accordance with the present invention, and FIG. 2 is a cross-sectional view of the embodiment of FIG. 1, taken at line 2—2 of FIG. 1.

DETAILED DESCRIPTION OF THE INVENTION

The embodiment of the invention shown in the drawing comprises a three leg or tripod lower section 10 comprising hollow legs 22, 24 and 26 extending from their lower ends at the sea floor 12 upwardly to their upper ends at a level below the water surface 14. The upper section of the structure comprises a central column or monopod 16 which is preferably centrally mounted at the top of the tripod 10 and extends upwardly to a level above the water line. The monopod supports a deck structure 18. The monopod 16 is supported against lateral movement by braces 20 which are attached to the legs 22, 24 and 26 of the tripod.

The legs 22, 24, 26 are battered to substantially the same degree, the battering ratio preferably being from about 1:8 to about 1:10. The battering ratio is the tangent of the angle between the leg and the vertical. A larger battering ratio results in a heavier and more costly structure, while a smaller ratio causes increased dynamic sensitivity. A battering ratio of between 1:8 and 1:10 has been determined to be the optimum to provide a structure which has a natural period no greater than about six seconds, which is substantially below the period of waves in water having a depth of 600 feet to 1,000 feet so that dynamic amplification of wave load is very low, without excess weight or cost. The legs of the structure may be symmetrical, i.e. a tripod's may be battered at 120° to each other and a quadropod's legs battered at 90° to each other, or two of the legs may be battered in one direction only, in the same plane, to facilitate launching the structure. Lateral bracing 28 between the legs of the tripod provide structural rigidity to the tripod.

The upper end of the tripod structure is below the level at which waves will impose a lateral load on the tripod, and is preferably at least 50 feet below the surface of the water with only the monopod 16 and monopod braces 20 extending upwardly from the tripod. The monopod braces are formed of structural elements which are much smaller in size then the legs 22, 24 and 26 and braces 28 of the tripod so that wave forces against the braces impart very little lateral load to the tripod. In addition, the central column 16 which extends through the surface of the water and to a position above it usually has a maximum diameter of about seven feet, preferably not much larger than the diameter of a single leg of the tripod. The monopod is preferably centrally disposed with respect to the upper end of the legs 22, 24 and 26, so that the weight of the monopod, the platform, and the equipment on the platform is substantially uniformly distributed between the three legs. The legs of the platform therefore may be designed so that each supports one-third of the axial load, for a tripod, or one-fourth of the axial load, for a quadropod.

The monopod is circular in cross-section and has a diameter sufficient to provide adequate support for the platform and equipment mounted thereon, and to provide adequate resistance to wave loading. Generally, a diameter of 60 to 80 inches is sufficient. The monopod diameter is tuned to the tripod geometry to produce low periods. Preferably, the structure as a whole is designed so as to have a natural period of no greater than about 8 seconds.

The structure of this invention is preferably completely assembled on shore, and then floated or transported by barge, in the horizontal position, to the wellsite. The structure may then be lowered into position, in a conventional manner, and pilings driven through the legs into the earth beneath the structure. Alternatively, skirt piles may be used to secure the platform to the bottom.

A structure built in accordance with this invention is substantially lighter, and therefore less expensive than a conventional rigid structure in which the tripod or quadropod extends upwardly to the platform level above the water. Thus, a structure to be installed in 950 feet of water will weigh about 2000 tons, as opposed to 12,000 to 15,000 tons for a conventional rigid structure.

Although the structure of this invention is particularly advantageous in deep water, over 600 feet, many of the advantages can also be obtained in shallower water. In such an installation, all of the legs may be vertical instead of battered.

The invention is not limited to the exact details of construction, operation or embodiments shown and described, since various modifications and equivalents will occur to those skilled in the art upon reading this specification. Accordingly, the invention is to be limited only by the scope of the following claims.

We claim:

1. An offshore structure for installation in a body of water comprising a tripod or quadropod base section extending upwardly from its lower end on the floor of the body of water to its upper end at least 50 feet below the surface of the body of water, a monopod mounted on the base section and extending upwardly therefrom to a level above the water, said monopod being substantially cylindrical and tuned to the geometry of the base section to produce a natural period substantially lower than the period of storm waves, and a platform mounted on top of the monopod.

2. An offshore structure as defined in claim 1 wherein each leg is battered at a ratio of from 1:8 to 1:10.

3. An offshore structure as defined by claim 2 wherein the legs are battered at equal angles.

4. An offshore structure as defined by claim 2 wherein two of the legs are battered in the same plane.

5. An offshore structure as defined by claim 2 wherein the monopod is substantially centrally disposed to the upper end of the base section.

6. An offshore structure as defined by claim 1 which is substantially rigid.

7. An offshore structure as defined by claim 1 in which the monopod diameter is not substantially greater than seven feet and the total height of the structure is at least about 600 feet.

8. An offshore structure for use in a body of water at a depth of from 600 to 1000 feet comprising a tripod or quadropod base section in which each leg is battered at a ratio of from 1:8 to 1:10, extending upwardly from its lower end on the floor of the body of water to its upper end at least 50 feet below the surface of the body of water, a monopod mounted near the upper end of the base section, substantially centrally disposed thereto and extending upwardly therefrom to a level above the maximum wave height of the water, said monopod being substantially circular in cross-section and tuned to the geometry of the base section to produce a natural period not substantially greater than about eight seconds, and a platform mounted on top of the monopod.

* * * * *